US006675778B1

(12) United States Patent
Kemper et al.

(10) Patent No.: US 6,675,778 B1
(45) Date of Patent: Jan. 13, 2004

(54) FUEL SENDER ASSEMBLY

(75) Inventors: Stephen Thomas Kemper, Canton, MI (US); DeQuan Yu, Ann Arbor, MI (US); David Zultowski, Canton, MI (US); Vipin F. Patel, Ann Arbor, MI (US); Norman Nelson Krieger, Milford, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/228,552

(22) Filed: Aug. 27, 2002

(51) Int. Cl.[7] ..... F02M 37/04
(52) U.S. Cl. ..... 123/516; 137/565.24; 123/509
(58) Field of Search ..... 123/519, 516, 123/514, 467, 518, 198 D; 137/574, 576, 565.22, 565.34, 565.24

(56) References Cited

U.S. PATENT DOCUMENTS

| | | | | | |
|---|---|---|---|---|---|
| 4,651,701 | A | | 3/1987 | Weaver | |
| 4,694,857 | A | | 9/1987 | Harris | |
| 4,747,388 | A | | 5/1988 | Tuckey | |
| 4,776,315 | A | | 10/1988 | Greiner | |
| 4,869,225 | A | | 9/1989 | Nagata et al. | |
| 4,945,884 | A | | 8/1990 | Coha et al. | |
| 4,971,017 | A | * | 11/1990 | Beakley et al. | 123/510 |
| 4,974,570 | A | | 12/1990 | Szwargulski et al. | |
| 5,038,741 | A | | 8/1991 | Tuckey | |
| 5,046,471 | A | * | 9/1991 | Schmid | 123/509 |
| 5,080,077 | A | | 1/1992 | Sawert et al. | |
| 5,398,659 | A | | 3/1995 | Zimmerman et al. | |
| 5,454,697 | A | | 10/1995 | Nakanishi | |
| 5,482,444 | A | | 1/1996 | Coha et al. | |
| 5,593,287 | A | | 1/1997 | Sadakata et al. | |
| 5,649,514 | A | | 7/1997 | Okada et al. | |
| 5,718,208 | A | * | 2/1998 | Brautigan et al. | 123/516 |
| 5,758,627 | A | | 6/1998 | Minagawa et al. | |
| 5,762,049 | A | | 6/1998 | Jones et al. | |
| 5,797,376 | A | * | 8/1998 | Frank et al. | 123/509 |
| 5,992,394 | A | | 11/1999 | Mukaidani et al. | |
| 6,029,633 | A | | 2/2000 | Brandt | |
| 6,073,614 | A | * | 6/2000 | Kleppner | 123/509 |
| 6,142,126 | A | | 11/2000 | Kanamaru | |
| 6,216,734 | B1 | * | 4/2001 | Umetsu et al. | 137/565.24 |
| 6,260,542 | B1 | * | 7/2001 | Kochsmeier et al. | 123/509 |

* cited by examiner

*Primary Examiner*—Carl S. Miller
(74) *Attorney, Agent, or Firm*—Brinks Hofer Gilson & Lione

(57) ABSTRACT

A fuel sender assembly comprises an electric fuel pump held in a mounting plate which is, in turn, mounted in a fuel tank, such as an automotive fuel tank. The mounting plate includes a chamber wall that defines a pump chamber having an inboard end and an outboard end. The electric fuel pump is received in the pump chamber such that an inlet end, which includes a fuel inlet, is disposed within the fuel tank adjacent the inboard end of the pump chamber. The outlet end of the fuel pump includes the electrical terminals and is disposed adjacent the outboard end of the pump chamber so that the electrical terminals are accessible outside the fuel pump for connection to an external power source. A hermetic seal is formed between the fuel pump and the chamber wall to prevent vapors from escaping through the pump chamber. The fuel sender assembly permits electrical connections to be made to the fuel pump without requiring wires within the fuel tank.

13 Claims, 3 Drawing Sheets

FUEL SENDER ASSEMBLY

TECHNICAL FIELD OF THE INVENTION

This invention relates to a fuel sender assembly that includes an electrical fuel pump held in a mounting plate mounted in a fuel tank. More particularly, this invention relates to a fuel sender assembly where in the mounting plate mounts the fuel pump such that the fuel inlet to the fuel pump is disposed within the fuel tank and the electrical terminals for the fuel pump are accessible outside the fuel tank, and wherein a hermetic seal is formed between the mounting plate and the fuel pump to contain fuel vapors within the fuel tank.

BACKGROUND OF THE INVENTION

In a typical automotive vehicle, fuel is supplied to an internal combustion engine from a fuel tank by a fuel sender assembly that includes an electric fuel pump mounted in the fuel tank. The electric fuel pump comprises electrical terminals connected to an external electrical system by wires within the fuel tank. There is concern that the wire insulation may become worn or damaged, or that the wires may become disconnected from the pump terminals, and that spurious sparking may occur. Under normal conditions, the fuel-rich vapors within the tank are deficient in oxygen and do not sustain combustion. Nonetheless, it is desired to prevent electrical sparking from contact with fuel vapors within the tank, as a precaution against even extraordinary circumstances that may arise, such as catastrophic breach of the fuel tank.

Therefore, it is desired to provide a fuel sender assembly that includes a fuel pump mounted in a fuel tank and wherein the electrical connections to the fuel pump are made directly to the fuel pump without wires within the fuel tank that may become worn or damaged or disconnected from pump terminals.

BRIEF SUMMARY OF THE INVENTION

In accordance with a preferred embodiment of this invention, a fuel sender assembly is provided for use in a fuel tank, such as a fuel tank for an automotive vehicle. A fuel sender assembly includes a mounting plate adapted to be mounted in the fuel tank. The mounting plate includes a chamber wall that defines a pump chamber. The chamber wall has an inboard end disposed within the fuel tank and an outboard end, and extends circumferentially about the pump chamber between the ends. The fuel sender assembly also includes an electric fuel pump received in the pump chamber. The inlet end of the fuel pump, which includes the fuel inlet, is disposed within the fuel tank adjacent the inboard end of the pump chamber. The outlet end, which includes the electrical terminals for connection to an external power source, are disposed adjacent the outboard end of the pump chamber. The fuel sender assembly further comprises sealing means for forming a hermetic seal between the chamber wall and the fuel pump to prevent vapors from escaping from the fuel tank through the pump chamber. In one aspect of this invention, the seal is formed by a sealing element interposed between the housing of the fuel pump and the chamber wall. In another aspect of this invention, the mounting plate includes a circumferental projection that extends inwardly about the pump chamber adjacent the outboard end, and the seal is formed by a sealing element that engages the circumferential projection and the outlet end of the fuel pump. Accordingly, this invention provides a fuel sender assembly wherein the fuel pump is retained in a mounting plate that is attached to a fuel tank and wherein the electrical terminals are accessible outside the tank to allow them to be connected without requiring wires within the tank.

BRIEF DESCRIPTION OF THE DRAWINGS

The present invention will be further illustrated with reference to the accompanying drawings wherein.

DETAILED DESCRIPTION OF THE INVENTION

Figure 1:
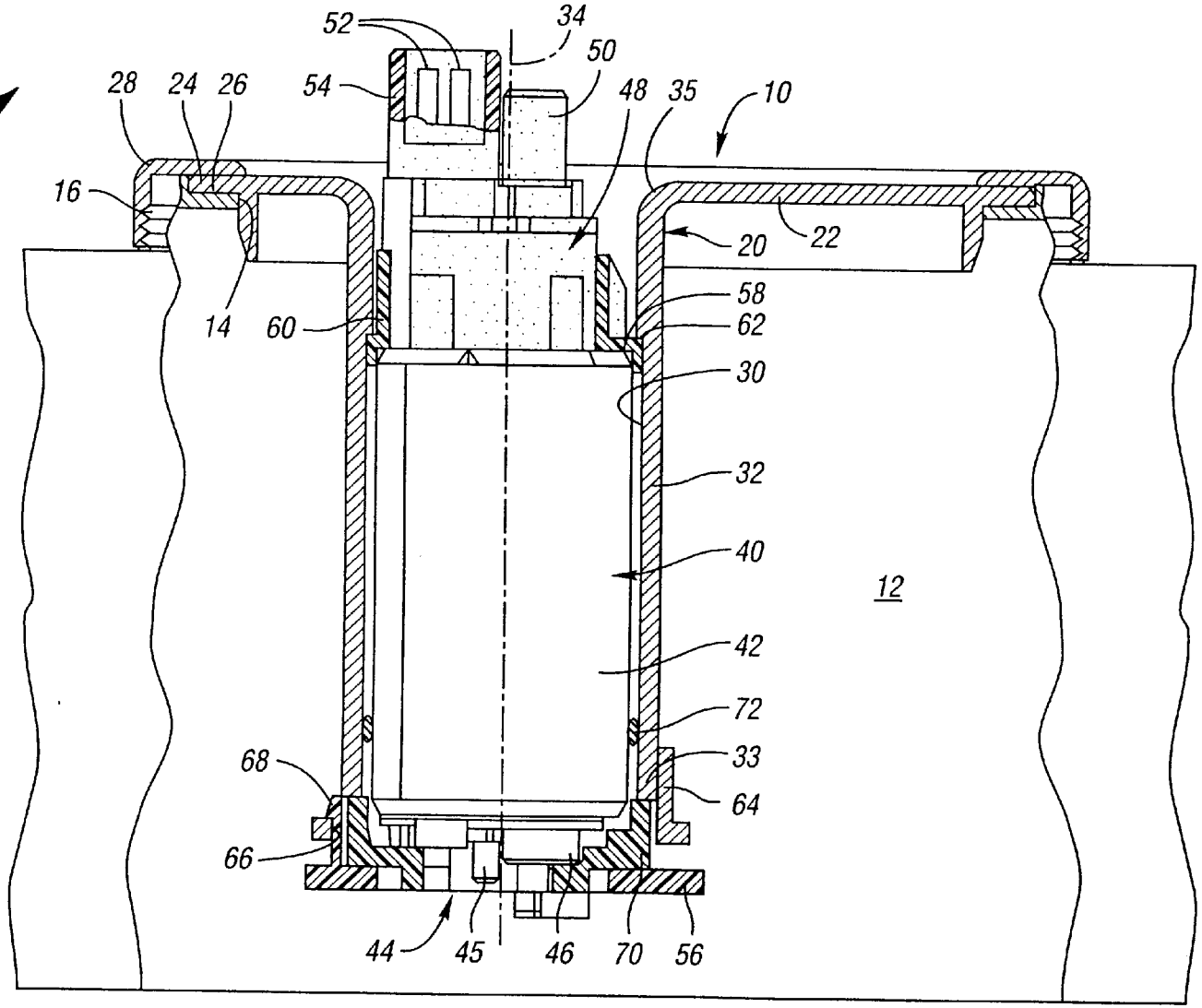
FIG. 1 is a cross-sectional view of a fuel sender assembly in accordance with a preferred embodiment of this invention.
Figure 2:
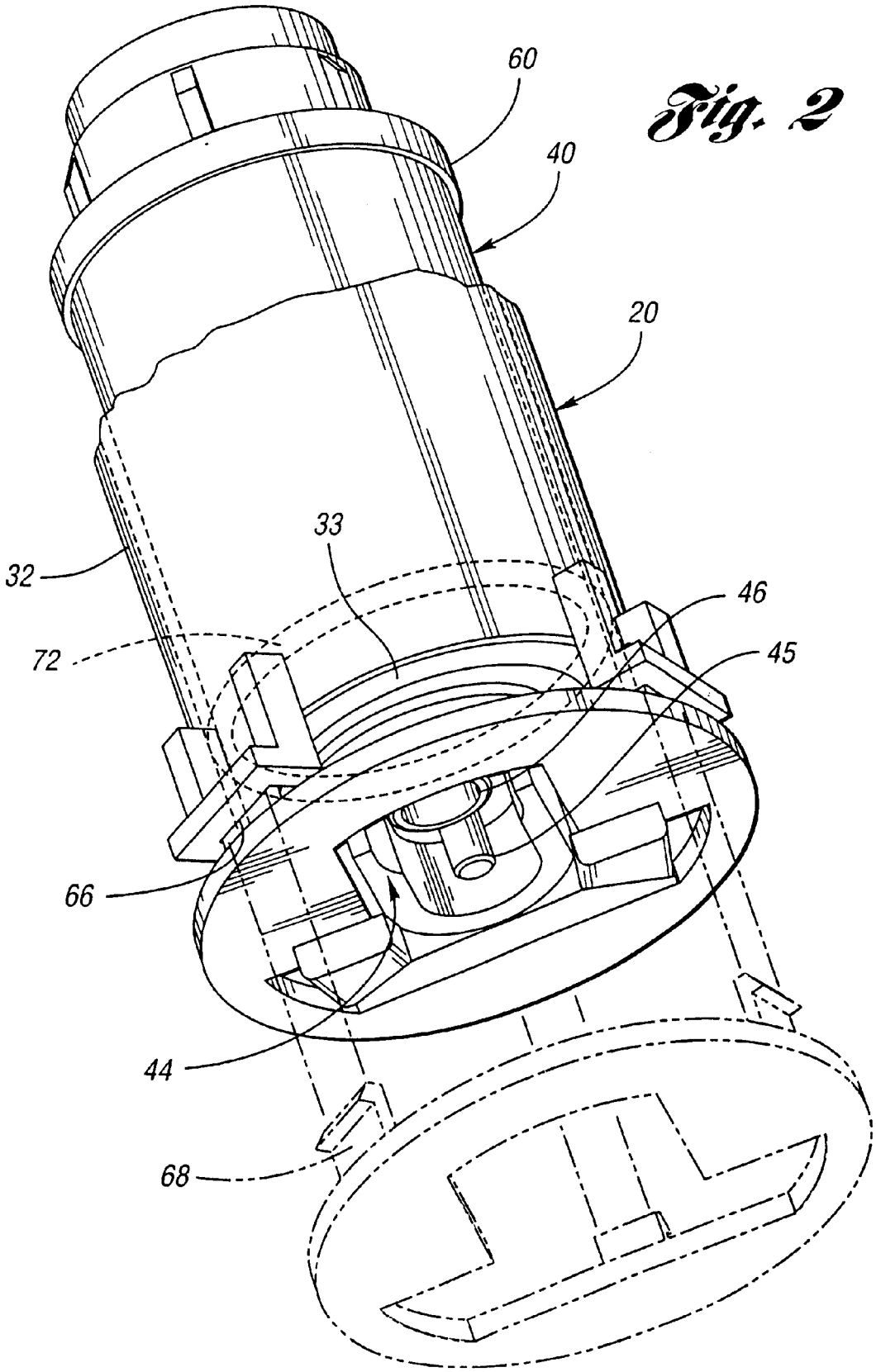
FIG. 2 is perspective view, partially cut-away, showing a fuel sender assembly in FIG. 1.

In accordance with a preferred embodiment of this invention, referring to FIG. 1 and 2, there is depicted a fuel sender assembly 10 that is adapted to be mounted in a fuel tank 12 and includes an electric fuel pump 40 for supplying fuel to an internal combustion engine of an automotive vehicle. The internal combustion engine may be either a diesel engine or a spark ignition engine. Fuel tank 12 includes an opening 14 surrounded by an externally threaded rim 16 into which assembly 10 is mounted, as hereinafter described.

Fuel sender assembly 10 comprises a mounting plate 20 that attaches fuel pump 40 in the fuel tank. Mounting plate 20 includes a flange 22 generally coextensive with opening 14. Flange 22 includes a perimeter 24 that rests on a ledge 26 formed about the inner circumference of rim 16, and is secured there by an internally threaded ring 28 that is screwed onto rim 16.

Mounting plate 20 includes a chamber wall 32 depending from flange 22 and defining a pump chamber 30 that is sized and shaped for receiving and retaining the fuel pump. In this embodiment, chamber 30 is cylindrical about an axis 34 that is perpendicular to flange 22. Wall 32 includes an inboard end 33 disposed within the fuel tank and an outboard end 35 adjacent flange 22.

Electric fuel pump 40 is received in pump chamber 30. By way of an example, a preferred fuel pump is commercially available from Visteon Corporation and designated model VP IL2U-9350-JA. Pump 40 comprises a pump housing 42, preferably formed of metal, that is generally cylindrical about axis 34 and encloses major elements of the fuel pump including an electric motor and pumping elements. Pump 40 includes an inlet end 44 that includes a fuel inlet 46 and is disposed adjacent inboard end 33. A sock filter (not shown) is attached to inlet 46 and secured on post 45. Pump 40 also includes an outlet end 48 adjacent outboard end 35 and comprising a fuel outlet 50 and electrical terminals 52 surrounded by a protective wall 54. A rolled shoulder 58 is formed in housing 42 adjacent outlet end, 46. It is an advantage of this invention that terminals 52 are accessible outside fuel tank 12 for convenient connection to a wiring harness for supplying electrical power to the pump from the vehicle electrical system, and also that outlet 50 is located outside the fuel tank for connection to a fuel line leading to the engine.

For assembly, pump 40 is coaxially inserted through inboard end 33 of chamber wall 32 and positioned against a stop 62 formed in chamber wall 32. A vibration insulator 60 is disposed about outlet end 48 and rolled edge 58 and is pressed against stop 62. Insulator 60 is formed of polymeric material effective to dampen vibrations generated by pump 40 during operation and thereby reduce noise. At inboard end 33, pump 40 is retained by a retainer 56. For this purpose, a bracket 64 is formed on the outer surface of wall 30 adjacent inboard end 33 and defines slots 66 that axially receive locking tabs 68 on retainer ring 56. An insulator 70 is disposed between retainer 56 and chamber wall 32 to dampen vibration of fuel pump 40 and thereby reduce noise from fuel pump operation. In this embodiment, insulators 58 and 70 are formed of low-density, compressible polymeric material, such as a foam material, to provide optimum vibration damping.

Fuel sender assembly also includes a sealing element 72 interposed between pump housing 42 and chamber wall 32 to form a hermetic seal to prevent fuel vapors within tank 12 from escaping through chamber 30 about the pump. Sealing element 72 comprises an O-ring that is slideably attached to pump housing 42 prior to insertion into chamber 30 and is formed of an elastomeric polymeric material impermeable to fuel vapors.

In the described embodiment, the fuel pump is protected from direct contact with the mounting plate by insulation provided by insulators 58 and 70. The seal is formed separate from the insulation to permit the materials to be selected having optimum properties for sealing or insulation, respectively. The seat is formed with minimal surface contact with the fuel pump and the mounting plate. This arrangement reduces noise that would otherwise result from vibration of the pump during operation. In an alternate embodiment, insulator 58, which retains the fuel pump within the mounting plate, may be formed to produce a seal and used either with or without a separate sealing element.

Therefore, this invention provides a fuel sender assembly that includes an electric fuel pump received in a pump chamber of a mounting plate that is affixed to the fuel tank. The inlet end of the fuel pump is located within the fuel tank to facilitate supply of fuel to the inlet. Fuel vapors are contained within the fuel tank by a sealing element that forms a hermetic seal between the pump and the mounting plate. The seal is formed between the inlet end of the pump and the electrical terminals, so that the terminals are accessible outside the tank. In this manner, electrical connections may be conveniently made to the electrical terminals. Moreover, by making connections to the terminals of the pump directly, no electrical wires are required within the fuel tank, and the risks associated with sparking because of in-tank wires is eliminated.

Figure 3:
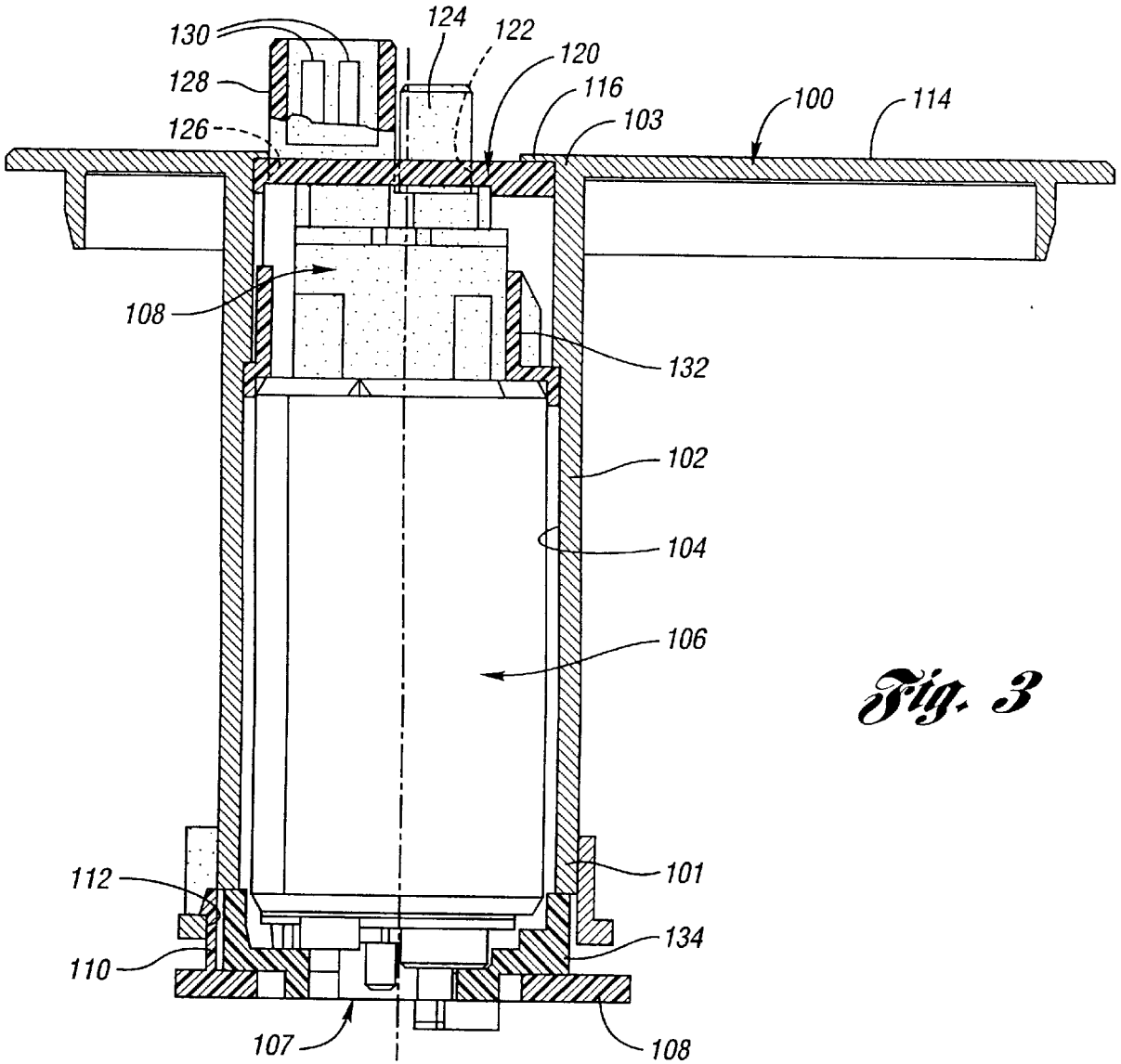
FIG. 3 is cross-sectional view of an alternate embodiment of a fuel sender assembly in accordance with this invention.

In the embodiment shown in FIGS. 1 and 2, a hermetic seal is formed between an external surface of the pump housing and an internal surface of the chamber wall. FIG. 3 depicts an alternate embodiment of this invention showing a fuel sender assembly having an outlet end seal arrangement. Pump 106 is similar to pump 40 in FIGS. 1 and 2 and includes an inlet end 107 and an outlet end 108. A mounting plate 100 includes a wall 102 that defines a chamber 104 for receiving fuel pump 106 and includes an inboard end 101 and an outboard end 103. At inboard end 101, pump 106 is retained in chamber 104 by a retaining ring 108 attached to chamber wall 102 by locking tabs 110 received in slots 112 in a manner similar to the retainer 56 shown in FIGS. 1 and 2. Mounting plate 100 further comprises a flange 114 adapted to be received in an opening in a fuel tank. In accordance with this embodiment, the outboard end 103 of wall 102 adjacent flange 114 includes an inwardly protruding lip 116 extending circumferentially about outlet end 108 of pump 106. A sealing element 120 is pressed against outlet end 108 of pump 106. Element 120 includes an opening 122 for received fuel outlet 124 of pump 106 and an opening 126 for receiving a protective wall 128 about terminals 130. The perimeter of the outer surface of element 120 is also pressed against lip 116 to form a hermetic seal. In this manner, fuel vapors are contained within the fuel tank and prevented from escaping through the pump chamber. In addition, sealing element 120 is held against lip 116 to prevent outboard displacement of the fuel pump. Insulators 132 and 134 are interposed between pump 106 and wall 102 to dampen vibration of the fuel pump during operation and thereby reduce noise. Thus, in this embodiment, fuel outlet 124 and terminals 130 are readily accessible outside the fuel tank for convenient connection to a fuel line and an electrical wiring harness, respectively. Moreover, electrical power is supplied without in-tank wires and the associated risks of electrical sparking.

While this invention has been described in terms of certain embodiments thereof, it is not intended to be limited to the described embodiments, but only to the extent set forth in claims that follow.

What is claimed is:

1. A fuel sender assembly for use in a fuel tank having an opening, said fuel sender assembly comprising:

a mounting plate adapted for mounting in the opening of the fuel tank, said mounting plate comprising a flange coextensive with the opening and a chamber wall defining a pump chamber having an inboard end disposed within the fuel tank and an outboard end adjacent the flange, said chamberwall comprising a circumferential projection extending inwardly about the pump chamber adjacent the outboard end, an electric fuel pump received in the pump chamber, said electrical fuel pump comprising an inlet end that includes a fuel inlet and is disposed adjacent the inboard end of the pump chamber, said electric fuel pump further comprising an outlet end that comprises a fuel outlet and electrical terminals adapted for connection to an external power source, said outlet end being adjacent the outboard end of the pump chamber such that the electrical terminals are accessible outside the fuel tank, and a sealing element engaging the circumferential projection and forming a hermetic seal between the outlet end of the electric fuel pump to prevent vapor escapes from the pump chamber.

2. A fuel sender assembly in accordance with claim 1 further comprising:

a retainer attached to the inboard end of the chamber wall to retain the electric fuel pump within the pump chamber.

3. A fuel sender assembly in accordance with claim 1 further comprising:

a vibration insulator element disposed between the electric fuel pump and the chamber wall.

4. A fuel sender assembly for use in a fuel tank comprising:

a mounting plate adapted for mounting in a fuel tank, said mounting plate comprising a chamber wall defining a pump chamber having an inboard end disposed within the fuel tank and an outboard end spaced apart from the inboard end, said chamber wall extending circumferentially about the pump chamber between said inboard end and said outboard end, an electric fuel pump received in the pump chamber, said electrical fuel pump comprising an inlet end that includes a fuel inlet and is disposed within the fuel tank and an outlet end that includes electrical terminals adapted for connection to an external power source, and sealing means for forming a hermetic seal between the chamber wall and the fuel pump to prevent vapors from escaping through the pump chamber about the electric fuel pump.

5. A fuel sender assembly in accordance with claim 4, wherein the electric fuel pump comprises a housing, and wherein the chamber wall extends circumferentially about the housing, and wherein the sealing means is disposed between the chamber wall and the pump housing.

6. A fuel sender assembly in accordance with claim 4, wherein the chamber wall defines a stop adjacent the pump chamber and effective to prevent outboard displacement of the electric pump, and wherein the fuel sender assembly further comprises a vibration insulator element disposed between the electric pump and the stop and effective to dampen vibration of the electric fuel pump during operation.

7. A fuel sender assembly in accordance with claim 4 further comprising:

a retainer attached to the inboard end of the chamber wall to retain the electric fuel pump within the pump chamber.

8. A fuel sender assembly in accordance with claim 4, wherein the sealing means forms the hermetic seal against the inlet end of the electric fuel pump.

9. A fuel send assembly for use in a fuel tank having an opening, said fuel sender assembly comprising:

a mounting plate adapted for mounting in the opening of the fuel tank, said mounting plate comprising a flange coextensive with the opening and a chamber wall defining a pump chamber having an inboard end disposed within the fuel tank and an outboard end adjacent the flange, said chamber wall extending circumferentially about an axis, an electric fuel pump received in the pump chamber, said electrical fuel pump comprising an inlet end that includes a fuel inlet and is disposed adjacent the inboard end of the pump chamber, said electric fuel pump further comprising an outlet end that comprises a fuel outlet and electrical terminals adapted for connection to an external power source, said outlet end being adjacent the outboard end of the pump chamber such that the electrical terminals are accessible outside the fuel tank, said fuel pump further comprising a pump housing surrounded by the chamber wall, and a sealing element disposed between the pump housing and the chamber wall and effective to form a hermetic seal to prevent vapor escape through the pump chamber about the electric fuel pump.

10. A fuel sender assembly in accordance with claim 9, further comprising:

a vibration insulator element disposed between the chamber wall and the electric fuel pump.

11. A fuel sender assembly in accordance with claim 9, wherein the chamber wall and the pump housing are cylindrical about the axis.

12. A fuel sender assembly in accordance with claim 9, further comprising a retainer attached to the inboard end of the chamber wall to retain the electric fuel pump within the pump chamber.

13. A fuel sender assembly in accordance with claim 9, wherein the pump housing includes a shoulder, and wherein the chamber wall defines a stop adapted to engage the shoulder to prevent outboard displacement of the electric fuel pump, and further comprising a vibration insulator element disposed between the shoulder and the stop.

* * * * *